US011495388B2

(12) United States Patent
Hirabayashi et al.

(10) Patent No.: US 11,495,388 B2
(45) Date of Patent: Nov. 8, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Tatsuo Hirabayashi, Mie (JP); Seiji Shitama, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 489 days.

(21) Appl. No.: 16/603,383

(22) PCT Filed: Apr. 4, 2018

(86) PCT No.: PCT/JP2018/014468
§ 371 (c)(1),
(2) Date: Oct. 7, 2019

(87) PCT Pub. No.: WO2018/193853
PCT Pub. Date: Oct. 25, 2018

(65) Prior Publication Data

US 2020/0035398 A1 Jan. 30, 2020

(30) Foreign Application Priority Data

Apr. 18, 2017 (JP) ..... JP2017-082393

(51) Int. Cl.
*H01F 27/24* (2006.01)
*H01F 27/26* (2006.01)
*H01F 27/32* (2006.01)

(52) U.S. Cl.
CPC ..... *H01F 27/263* (2013.01); *H01F 27/323* (2013.01)

(58) Field of Classification Search
CPC .... H01F 27/263; H01F 27/323; H01F 27/306; H01F 27/325; H01F 27/327; H01F 37/00
See application file for complete search history.

(56) References Cited

U.S. PATENT DOCUMENTS 10,141,093 B2 * 11/2018 Inaba ..... H01F 27/2823
2017/0053731 A1 2/2017 Misaki et al.
2018/0211758 A1 7/2018 Shitama et al.

FOREIGN PATENT DOCUMENTS

JP 2015-130410 A 7/2015
JP 2016-082043 A 5/2016

OTHER PUBLICATIONS

International Search Report, Application No. PCT/JP2018/014468, dated Jun. 26, 2018. ISA/Japan Patent Office.

* cited by examiner

*Primary Examiner* — Tuyen T Nguyen
(74) *Attorney, Agent, or Firm* — Honigman LLP

(57) ABSTRACT

A reactor has a coil and a loop-shaped magnetic core disposed extending inside and outside the coil. The coil has two winding portions that are disposed laterally side-by-side, and the magnetic core has two inner core portions that are disposed inside the winding portions, and two outer core portions that are disposed outside the winding portions and connect end portions of the two inner core portions. The reactor includes an inner resin portion obtained by filling a space between inner peripheral faces of the winding portions and the inner core portions, end face intervening members disposed between end faces of the winding portions and the outer core portions, and spacer pieces that are integrated with the end face intervening members and are disposed (Continued)

extending between an entirety of mutually opposing inward faces of the two winding portions.

4 Claims, 7 Drawing Sheets

REACTOR

CROSS-REFERENCE TO RELATED APPLICATIONS

This application is the U.S. national stage of PCT/JP2018/014468 filed on Apr. 4, 2018, which claims priority of Japanese Patent Application No. JP 2017-082393 filed on Apr. 18, 2017, the contents of which are incorporated herein.

TECHNICAL FIELD

The present disclosure relates to a reactor.

BACKGROUND

A reactor is one component in a circuit for performing voltage step-up and step-down. For example, JP 2017-28142A discloses a reactor that includes a coil provided with winding portions, a magnetic core that is disposed extending inside and outside the coil (winding portions) and forms a closed magnetic circuit, and an insulating intervening member that is disposed between the coil (winding portions) and the magnetic core. The coil has a pair of winding portions that are disposed in parallel, and the winding portions are each shaped as a quadrangular tube. The magnetic core is loop-shaped and constituted by inner core portions that are disposed inside the winding portions and outer core portions that are disposed outside the winding portions. The insulating intervening member is constituted by inner intervening members that are disposed between the inner peripheral faces of the winding portions and the outer peripheral faces of the inner core portions, and end face intervening members that are disposed between the end faces of the winding portions and the outer core portions. The reactor disclosed in JP 2017-28142A further includes an inner resin portion obtained by filling the space between the inner peripheral faces of the winding portions of the coil and the outer peripheral faces of the inner core portions with resin.

With the reactor disclosed in JP 2017-28142A, the inner intervening members are disposed between the inner peripheral faces of the winding portions and the outer peripheral faces of the inner core portions in order to retain gaps (resin flow paths) between the winding portions and the inner core portions. The inner resin portion is then formed by introducing resin from the end face sides of the winding portions so as to flow through resin filling holes formed in the end face intervening members and then into the gaps between the winding portions and the inner core portions.

In the case of the above-described reactor that includes a coil provided with two winding portions and a loop-shaped magnetic core disposed extending inside and outside the coil (winding portions), the winding portions sometimes undergo deformation when the inner resin portion is formed by filling the space between the inner peripheral faces of the winding portions and the outer peripheral faces of the inner core portions with resin.

Generally, the resin for forming the inner resin portion is introduced by applying pressure to the resin through injection molding, and a large amount of pressure needs to be applied in order for the resin to sufficiently spread throughout narrow regions between the inner peripheral faces of the winding portions and the outer peripheral faces of the inner core portions. The winding portions thus sometimes deform in a manner of bulging outward due to the pressure of the resin, and in some cases, it is possible for contact to occur between the winding portions (specifically, the mutually opposing inward faces of the two winding portions). If the winding portions come into contact with each other, there is a risk of not being able to ensure electrical insulation between the winding portions. Particularly, if the end faces of the winding portions are rectangular, and the winding portions are disposed such that the long end sides of the rectangular shape of the end faces are the inward faces, a greater amount of deformation occurs at the inward faces, and the winding portions are more likely to come into contact with each other.

In view of this, an object of the present disclosure is to provide a reactor in which, when the inner resin portion is formed by filling the space between the inner peripheral faces of the winding portions of the coil and the inner core portions of the magnetic core with resin, it is possible to suppress deformation of the winding portions and avoid contact between the winding portions.

SUMMARY

A reactor according to the present disclosure is a reactor including a coil and a loop-shaped magnetic core disposed extending inside and outside the coil, wherein the coil has two winding portions that are disposed laterally side-by-side, the magnetic core has two inner core portions that are disposed inside the winding portions, and two outer core portions that are disposed outside the winding portions and connect end portions of the two inner core portions. The reactor further includes an inner resin portion obtained by filling a space between inner peripheral faces of the winding portions and the inner core portions; end face intervening members disposed between end faces of the winding portions and the outer core portions; and spacer pieces that are integrated with the end face intervening members and are disposed extending between an entirety of mutually opposing inward faces of the two winding portions.

Advantageous Effects of the Present Disclosure

According to a reactor of the present disclosure, when the inner resin portion is formed by filling the space between the inner peripheral faces of the winding portions of the coil and the inner core portions of the magnetic core with resin, it is possible to suppress deformation of the winding portions and avoid contact between the winding portions.

DETAILED DESCRIPTION OF PREFERRED EMBODIMENTS

Figure 1:
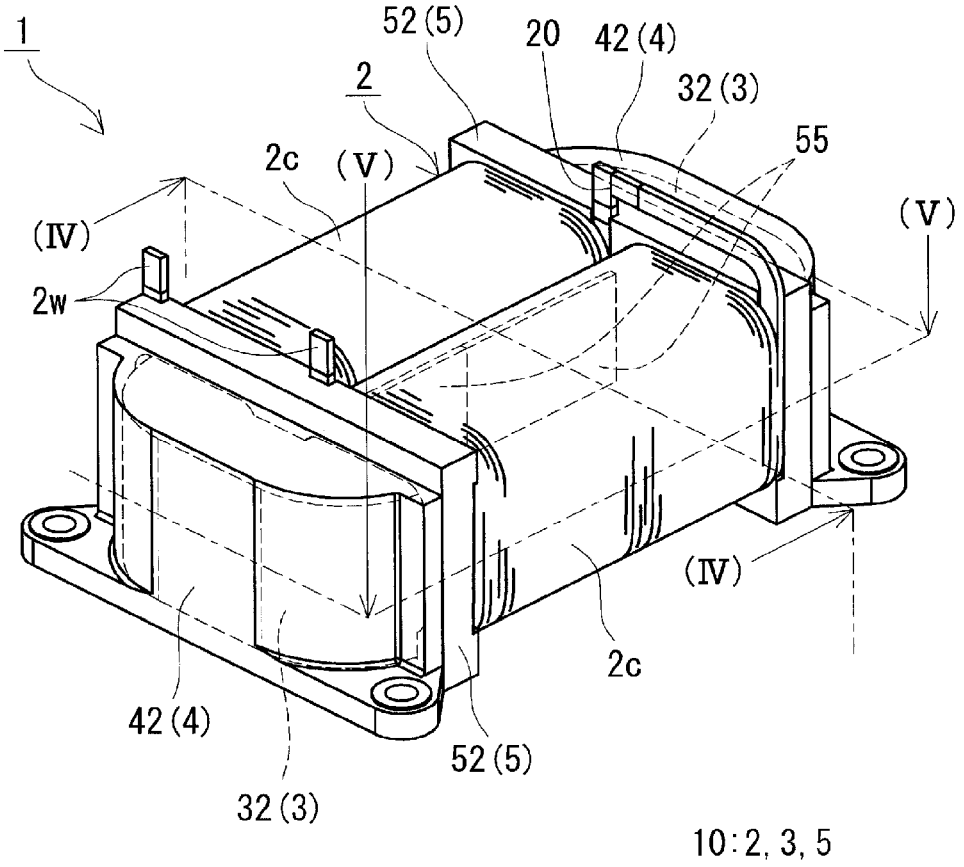
FIG. 1 is a schematic perspective view of a reactor according to a first embodiment.

First, embodiments of the present disclosure will be listed and described.

A reactor according to an aspect of the present disclosure is a reactor including a coil and a loop-shaped magnetic core disposed extending inside and outside the coil, wherein the coil has two winding portions that are disposed laterally side-by-side, the magnetic core has two inner core portions that are disposed inside the winding portions, and two outer core portions that are disposed outside the winding portions and connect end portions of the two inner core portions. The reactor further includes an inner resin portion obtained by filling a space between inner peripheral faces of the winding portions and the inner core portions; end face intervening members disposed between end faces of the winding portions and the outer core portions; and spacer pieces that are integrated with the end face intervening members and are disposed extending between an entirety of mutually opposing inward faces of the two winding portions.

According to this reactor, due to the spacer pieces that are provided, it is possible to suppress outward deformation of the inward faces of the winding portions caused by the pressure of resin when the space between the inner peripheral faces of the winding portions and the inner core portions is filled with resin in order to form the inner resin portion, and it is possible to avoid contact between the inward faces of the two winding portions. Also, due to the spacer pieces being disposed between the winding portions, electrical insulation between the winding portions can be ensured by the spacer pieces.

The spacer pieces are disposed extending between the entirety of the mutually opposing inward faces of the two winding portions, thus making it possible to suppress deformation over the entirety of the inward faces and to avoid contact between the winding portions caused by deformation of the winding portions. Here, "disposed extending between the entirety of the inward faces" means being provided so as to face the entirety of the inward faces of the two winding portions and being in contact with the entirety of the inward faces (entire lengths and heights thereof) of the winding portions. Here, if the spacer pieces are not provided extending over the entirety of the inward faces of the winding portion, portions of the inward faces may deform at locations not in contact with the spacer pieces, and there is a possibility of not being able to avoid contact between the inward faces.

Also, the spacer pieces are integrated with the end face intervening members, thus making it possible to improve workability. As one means for suppressing deformation of the winding portions and avoiding contact between the winding portions, it is conceivable to dispose plate-shaped spacers between the winding portions before filling the gaps between the winding portions and the inner core portions with resin. However, in this case, such spacers need to be provided separately, and it is necessary to remove the spacers after the resin is introduced and allowed to cure. There is also a possibility of forgetting to remove the spacers or damaging the insulating coatings of the winding wires that form the winding portions when removing the spacers. In the above-described reactor, the spacer pieces are integrated with the end face intervening members, thus eliminating the need to separately provide spacers and remove such spacers, and there is also little risk of damaging the inward faces of the winding portions.

In an aspect of the reactor, a height of the spacer pieces in an up-down direction is greater than a height of the inward faces of the winding portions, and upper end portions and lower end portions of the spacer pieces project beyond the inward faces.

The upper end portions and lower end portions of the spacer pieces project upward and downward from the inward faces, thus making it possible to ensure a necessary creepage distance between the winding portions and improve the electrical insulation between the winding portions.

In an aspect of the reactor, end faces of the winding portions have a rectangular shape in a view along an axial direction, and the winding portions are disposed such that long end sides of the rectangular shape of the end faces are the inward faces.

If the end faces of the winding portion have a rectangular shape, the outer peripheral faces of the winding portion that are on the long end sides of the rectangular shape more easily undergo deformation under the pressure of resin than the faces on the short end sides. For this reason, if the winding portions are disposed such that the long end sides of the rectangular shape of the end faces are the inward faces, deformation more easily occurs at the inward faces, and the winding portions are more likely to come into contact with each other. According to the above-described reactor, if the winding portions are disposed such that the long end sides of the rectangular shape of the end faces are the inward faces, the spacer pieces can suppress deformation of the inward faces of the winding portions, and thus are very effective.

Hereinafter, a concrete example of a reactor according to an embodiment of the present disclosure will be described with reference to the drawings. In the drawings, like reference numerals denote objects having like names. Note that the present disclosure is not limited to the following examples, but rather is defined by the claims, and all changes that come within the meaning and range of equivalency of the claims are intended to be embraced therein.

First Embodiment

Configuration of Reactor

Figure 2:
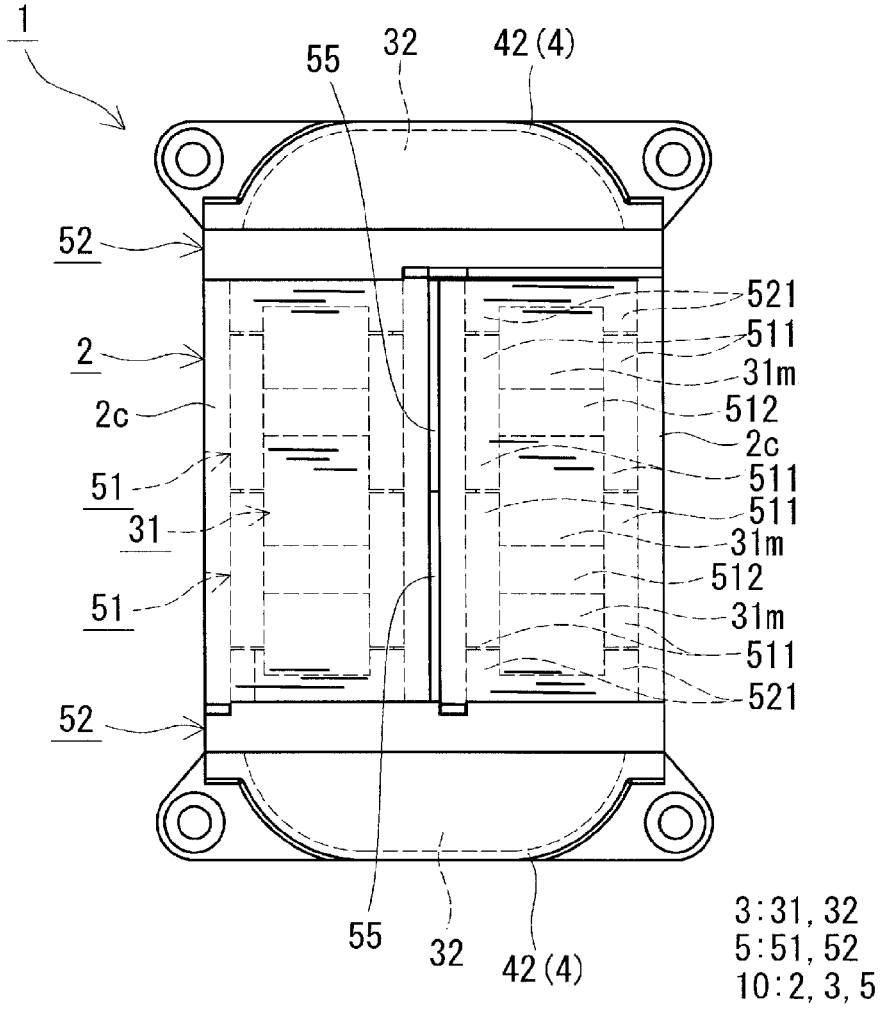
FIG. 2 is a schematic top view of the reactor according to the first embodiment.
Figure 3:
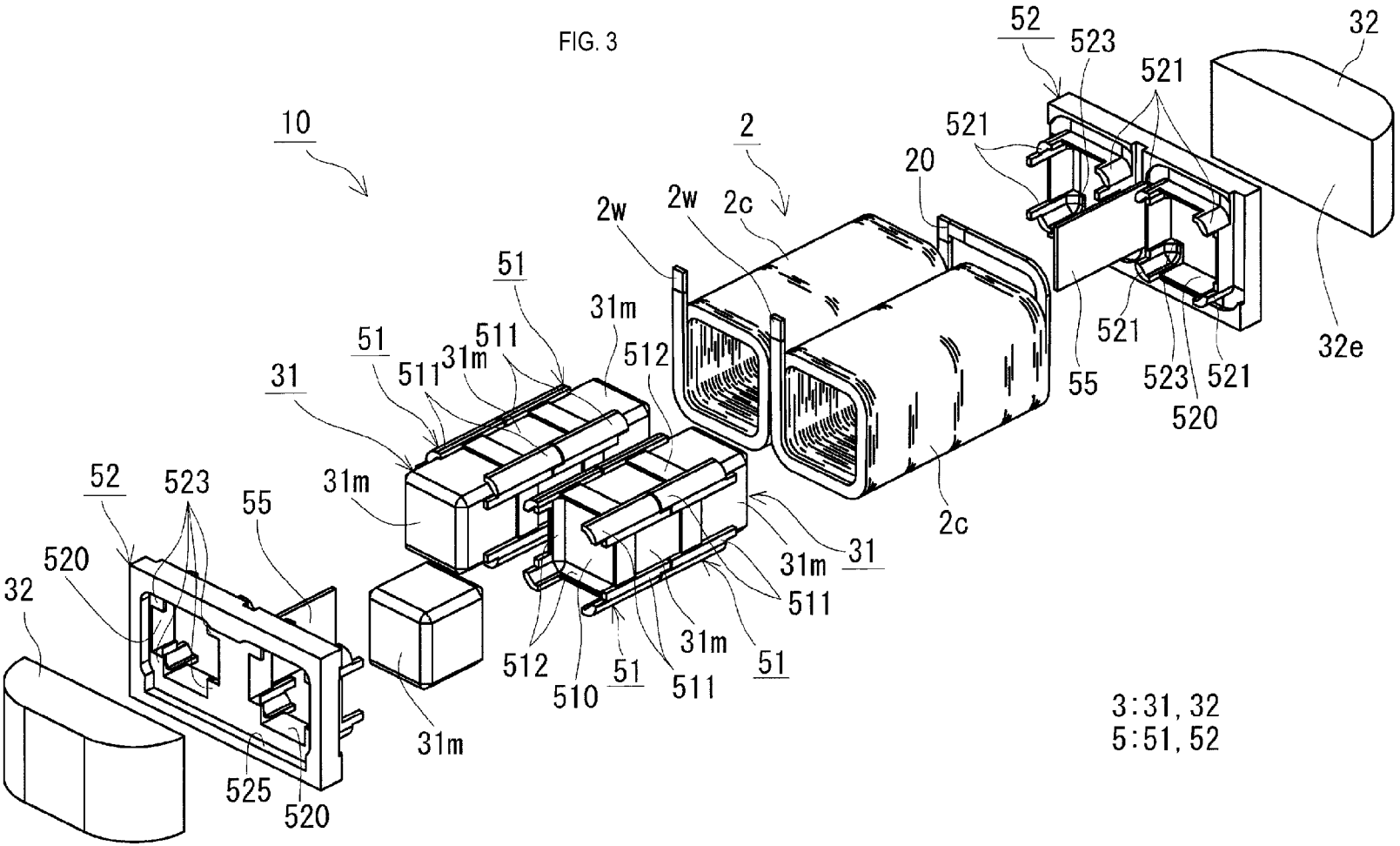
FIG. 3 is a schematic perspective view of an assembly included in the reactor according to the first embodiment.
Figure 4:
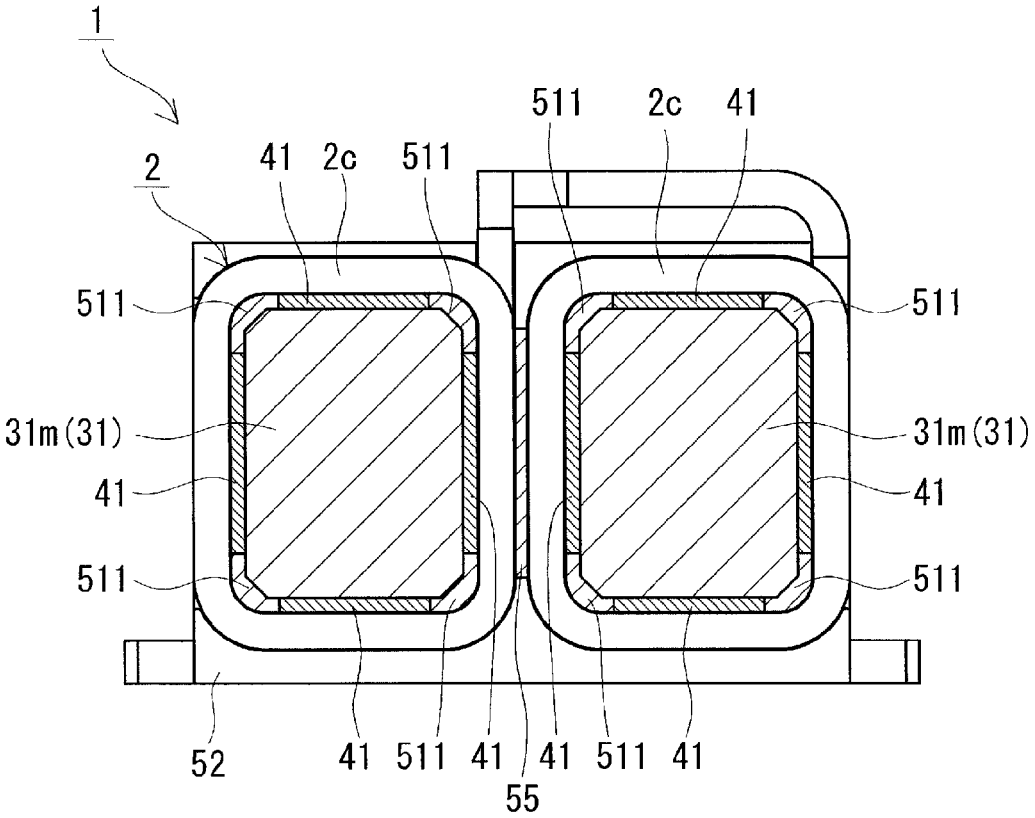
FIG. 4 is a schematic transverse sectional view taken along line (IV)-(IV) shown in FIG. 1.
Figure 5:
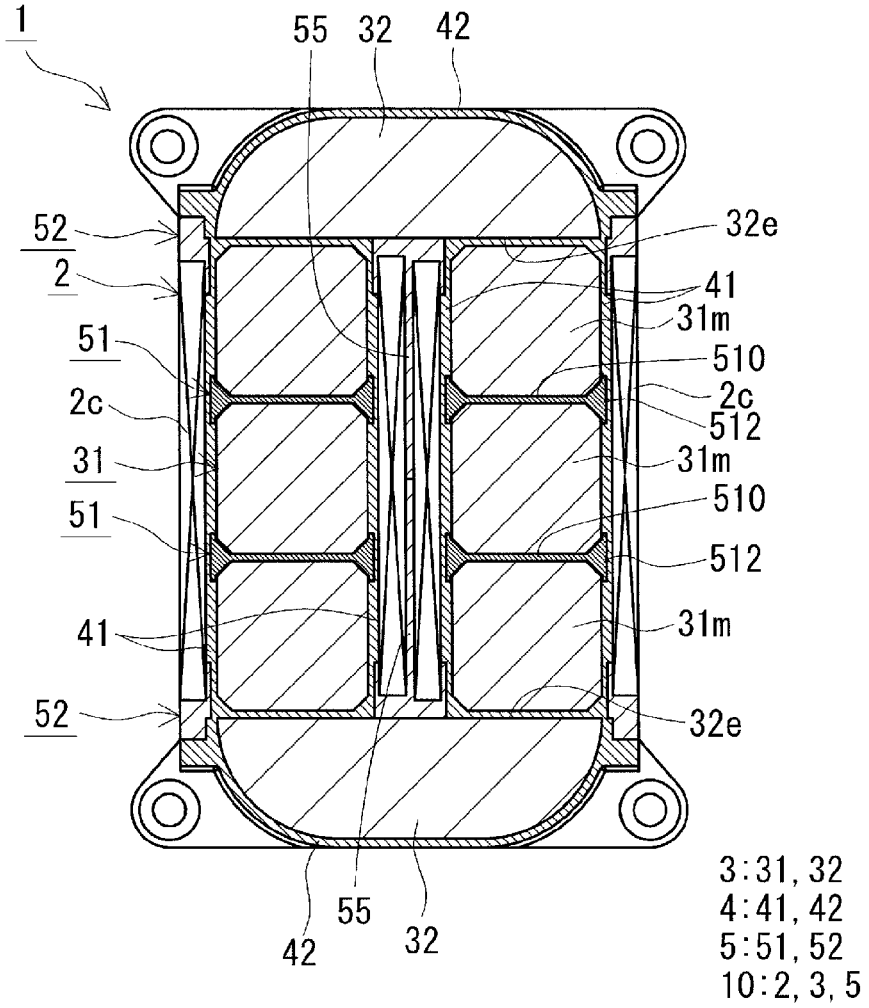
FIG. 5 is a schematic planar sectional view taken along line (V)-(V) shown in FIG. 1.

A reactor 1 according to a first embodiment will now be described with reference to FIGS. 1 to 6. As shown in FIGS. 1 to 3, the reactor 1 of the first embodiment is constituted by an assembly 10 that includes a coil 2 provided with two winding portions 2*c*, a magnetic core 3 disposed extending inside and outside the winding portions 2*c*, and an insulating intervening member 5 that includes end face intervening members 52. The two winding portions 2*c* are disposed laterally side-by-side with each other. The magnetic core 3 includes two inner core portions 31 that are respectively disposed inside the winding portions 2*c*, and two outer core portions 32 that are disposed outside the winding portions 2*c* and connect end portions of the two inner core portions 31. Also, as shown in FIGS. 4 and 5, the reactor 1 includes an inner resin portion 41 (molded resin portion 4) obtained by filling the space between the inner peripheral faces of the winding portions 2*c* and the inner core portions 31 with resin. One feature of the reactor 1 is that it includes spacer pieces 55 that are disposed between the opposing inward faces of the two winding portions 2*c*.

The reactor 1 is installed in an installation target (not shown) such as a converter case. Here, the lower side of the reactor 1 (coil 2 and magnetic core 3) with respect to the paper surface in FIGS. 1 and 4 is the installation side that faces the installation target, and accordingly the installation side will be referred to as the "lower" side, the side opposite thereto will be referred to as the "upper" side, and the up-down direction will be referred to as the height direction. Also, the side-by-side direction (left-right direction with respect to the paper surface in FIG. 2) of the winding portions 2*c* (inner core portions 31) will be referred to as the horizontal direction, and the direction extending along the axial direction (up-down direction with respect to the paper surface in FIG. 2) of the winding portions 2*c* (inner core portions 31) will be referred to as the length direction. FIG. 4 is a transverse sectional view taken along the horizontal direction, which is orthogonal to the length direction, of the winding portions 2*c*, and FIG. 5 is a planar sectional view taken along a plane that cuts the winding portions 2*c* in the up-down direction. The configuration of the reactor 1 will be described in detail below.

Coil

As shown in FIGS. 1 to 3, the coil 2 has two winding portions 2*c* that are each constituted by a winding wire 2*w* coiled in a spiral manner, and end portions on one side of the winding wires 2*w* that form the winding portions 2*c* are connected to each other via a joining portion 20. The two winding portions 2*c* are disposed laterally side-by-side (in parallel) with each other such that the axial directions thereof are parallel with each other. The joining portion 20 is formed by performing welding, soldering, brazing, or the like to join together end portions on one side of the winding wires 2*w* that are drawn out from the winding portions 2*c*. End portions on the other side of the winding wires 2*w* are drawn out in an appropriate direction (upward in this example) from the winding portions 2*c*, and terminal fittings (not shown) are appropriately attached to these end portions for electrical connection to an external apparatus (not shown) such as a power supply. The coil 2 can be a known coil, and the two winding portions 2*c* may be formed by a single continuous winding wire, for example.

Winding Portions

In the two winding portions 2*c*, the winding wires 2*w* have the same specifications, and furthermore, the shapes, sizes, winding directions, and numbers of turns are the same as each other, and adjacent turns in each winding portion 2*c* are in close contact with each other. The winding wires 2*w* are coated wires (so-called enameled wires) that include a conductor (copper or the like) and an insulating coating (polyamide imide or the like) that surrounds the conductor, for example. In this example, the winding portions 2*c* are each a quadrangular tube-shaped (specifically, a rectangular tube-shaped) edgewise coil in which the winding wire 2*w*, which is a coated rectangular wire, is wound edgewise, and the end faces of the winding portions 2*c* are rectangular with rounded corners when viewed along the axial direction (see FIG. 4 as well). As shown in FIG. 4, the outer peripheral surface of each winding portion 2*c* has four flat faces (an upper face, a lower face, and two side faces) and four corner portions, and one of the two side faces that opposes the other winding portion 2*c* is the inward face, and the side face located on the opposite side is the outward face. The winding portions 2*c* are disposed such that, in terms of the shape of the end face, the pair of short end sides are the upper face and the lower face, and the pair of long end sides are the inward face and the outward face. The winding portions 2*c* are not particularly limited to having this shape, and may be elongated cylinder-shaped (racetrack-shaped) or the like.

The height of the inward faces of the winding portions (the length of the long end sides in terms of the shape of the end face, excluding the corner portions) is in the range of 30 mm to 100 mm inclusive for example, and the gap between the winding portions 2*c* (the length of the space between the inward faces) is in the range of 1 mm to 5 mm inclusive for example.

In this example, the coil 2 (the winding portions 2*c*) are not covered by the later-described molded resin portion 4, and when the reactor 1 is obtained, the outer peripheral surface of the coil 2 is exposed as shown in FIG. 1. For this reason, heat is easily dissipated outward from the coil 2, and it is possible to improve the heat dissipation performance of the coil 2.

Alternatively, the coil 2 may be a molded coil that includes molded electrically insulating resin. In this case, the coil 2 can be protected from the outside environment (dust, corrosion, and the like), and it is possible to improve the mechanical strength and the electrical insulation performance of the coil 2. For example, covering the inner peripheral faces of the winding portions 2*c* with resin makes it possible to improve electrical insulation between the winding portions 2*c* and the inner core portion 31. Examples of the resin formed around the coil 2 include: a thermosetting resin such as epoxy resin, unsaturated polyester resin, urethane resin, or silicone resin; and a thermoplastic resin such as polyphenylene sulfide (PPS) resin, polytetrafluoroethylene (PTFE) resin, liquid crystal polymer (LCP), polyamide (PA) resin such as nylon 6 or nylon 66, polyimide (PI) resin, polybutylene terephthalate (PBT) resin, or acrylonitrile butadiene styrene (ABS) resin.

Alternatively, the coil 2 may be a thermally fused coil in which thermal fusion layers are provided between adjacent turns in the winding portions 2*c*, and the adjacent turns are thus thermally fused together. In this case, the adjacent turns can be in closer contact with each other.

As shown in FIGS. 2, 3, and 5, the magnetic core 3 includes two inner core portions 31 that are disposed inside the winding portions 2*c*, and two outer core portions 32 that are disposed outside the winding portions 2*c*. The inner core portions 31 are located inside the winding portions 2*c* that are disposed laterally side-by-side, and are portions where the coil 2 is disposed. In other words, the two inner core portions 31 are disposed laterally side-by-side (in parallel) similarly to the winding portions 2*c*. Axial end portions of the inner core portions 31 may partially project outward from the winding portions 2*c*. The outer core portions 32 are located outside the winding portions 2*c*, and are portions where the coil 2 is substantially not disposed (i.e., portions that project outward (are exposed) from the winding portions 2*c*). The outer core portions 32 are provided so as to connect the end portions of the two inner core portions 31. In this example, the outer core portions 32 are disposed so as to sandwich the two ends of the inner core portions 31, and the end faces of the inner core portions 31 on each side are connected to an inward end face 32*e* of the corresponding outer core portion 32, thus obtaining the loop-shaped magnetic core 3. When the coil 2 receives a supply of electricity and becomes excited, magnetic flux flows in the magnetic core 3, thus forming a closed magnetic circuit.

Inner Core Portions

The shape of the inner core portions 31 corresponds to shape of the inner peripheral surface of the winding portions 2*c*. In this example, the inner core portions 31 are shaped as quadrangular columns (rectangular columns), and the end faces of the inner core portions 31 are rectangular with rounded corners in a view along the axial direction (see FIG. 4 as well). As shown in FIG. 4, the outer peripheral surface of each of the inner core portions 31 has four flat faces (an upper face, a lower face, and two side faces) and four corner portions. Also, in this example, as shown in FIGS. 2, 3, and 5, the inner core portions 31 each have a plurality of inner core pieces 31*m*, and the inner core pieces 31*m* are connected in the length direction.

The inner core portions 31 (the inner core pieces 31*m*) are formed from a material that contains a soft magnetic material. The inner core pieces 31*m* are formed from, for example, a powder compact obtained by compressing and molding a soft magnetic powder made of iron or an iron alloy (e.g., Fe—Si alloy, Fe—Si—Al alloy, or Fe—Ni alloy) and furthermore a coated soft magnetic powder having an insulating coating, or a compact of a composite material containing a soft magnetic powder and resin. The resin contained in the composite material can be a thermosetting resin, thermoplastic resin, room temperature curing resin, low temperature curing resin, or the like. Examples of a thermosetting resin include unsaturated polyester resin, epoxy resin, urethane resin, and silicone resin. Examples of a thermoplastic resin include PPS resin, PTFE resin, LCP, PA resin, PI resin, PBT resin, and ABS resin. Alternatively, it is also possible to use a BMC (Bulk Molding Compound), which is obtained by mixing unsaturated polyester with calcium carbonate and glass fibers, millable silicone rubber, millable urethane rubber, or the like. In this example, the inner core pieces 31*m* are each formed by a powder compact.

Outer Core Portions

The outer core portions 32 are each constituted by one core piece. Similarly to the inner core pieces 31*m*, the outer core portions 32 are formed from a material that contains a soft magnetic material, and can be constituted by any of the above-described power compacts or composite materials. In this example, the outer core portions 32 are each formed by a powder compact.

Insulating Intervening Member

The insulating intervening member 5 is a member that is disposed between the coil 2 (winding portions 2*c*) and the magnetic core 3 (inner core portions 31 and outer core portions 32) and ensures electrical insulation between the coil 2 and the magnetic core 3, and includes inner intervening members 51 and end face intervening members 52. The insulating intervening member 5 (inner intervening members 51 and end face intervening members 52) is formed from an electrically insulating resin, examples of which include epoxy resin, unsaturated polyester resin, urethane resin, silicone resin, PPS resin, PTFE resin, LCP, PA resin, PI resin, PBT resin, ABS resin.

Inner Intervening Members

As shown in FIGS. 3 to 5, the inner intervening members 51 are disposed between the inner peripheral faces of the winding portions 2*c* and the outer peripheral faces of the inner core portions 31, and ensure electrical insulation between the winding portions 2*c* and the inner core portions 31. In this example, as shown in FIGS. 3 and 5, the inner intervening members 51 each include a rectangular plate-shaped plate portion 510 that is disposed between two inner core pieces 31*m*, and projecting pieces 511 that are formed at corner portions of the plate portion 510 and extend in the length direction along the corner portions of two adjacent inner core pieces 31*m*. Furthermore, in this example, frame portions 512 that surround the peripheral edge portions of the end faces of the two adjacent inner core pieces 31*m* are formed at the outer edge portions of the plate portion 510. The plate portion 510 functions as a gap that maintains the separation between the inner core pieces 31*m*. The projecting pieces 511 hold the corner portions of the inner core pieces 31*m* and are disposed between the inner peripheral faces of the winding portions 2*c* and the outer peripheral faces of the inner core pieces 31*m* so as to position the inner core pieces 31*m* (inner core portions 31) inside the winding portions 2*c*. As shown in FIG. 4, the projecting pieces 511 form gaps between the inner peripheral faces of the winding portions 2*c* and the outer peripheral faces of the inner core portions 31, thus ensuring gaps at the four faces (upper face, lower face, and two side faces) of the inner core portions 31. These gaps serve as flow paths for the resin that is to form the later-described inner resin portion 41 (see FIGS. 4 and 5), and the inner resin portion 41 is formed by filling the gaps with resin. Also, as shown in FIG. 3, the projecting pieces 511 of adjacent inner intervening members 51 abut against each other and are connected to each other.

End Face Intervening Members

Figure 6:
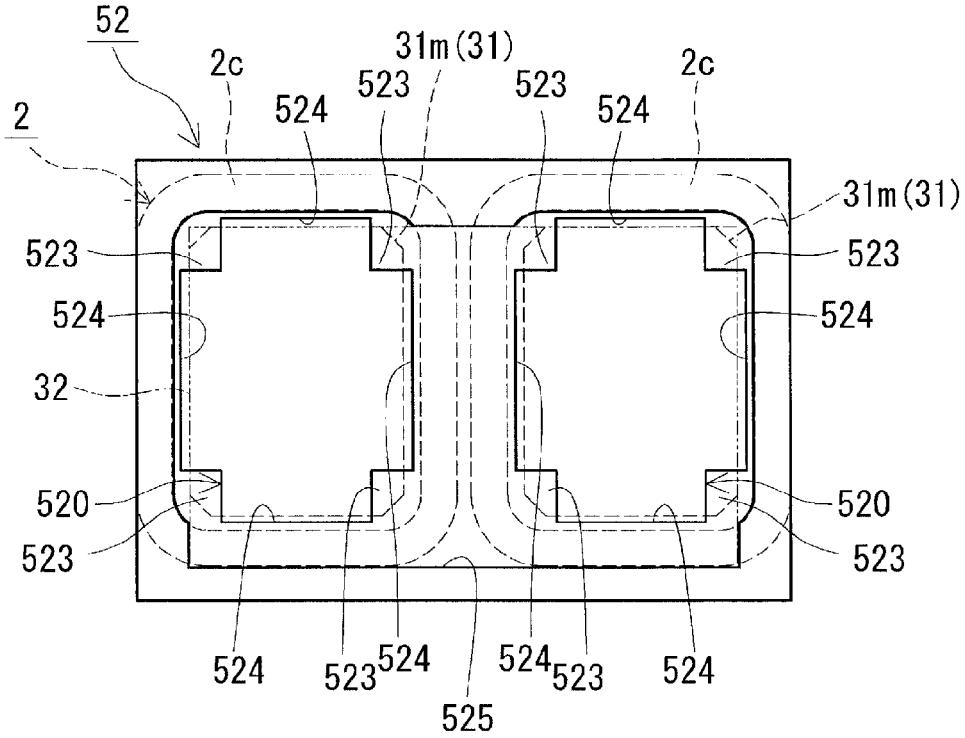
FIG. 6 is a schematic front view of an end face intervening member included in the reactor according to the first embodiment, as seen from the front face side.

As shown in FIGS. 3 and 5, the end face intervening members 52 are disposed between the end faces of the winding portions 2*c* and the inward end faces 32*e* of the outer core portions 32, and ensure electrical insulation between the winding portions 2*c* and the outer core portions 32. The end face intervening members 52 are disposed at the two ends of the winding portions 2*c*, and as shown in FIG. 3, are rectangular frame-shaped bodies that each include two through-holes 520 for insertion of the inner core portions 31. In this example, as shown in FIG. 6, when viewed from the outer core portion 32 side (front side), the end face intervening members 52 each include projections 523 that project inward into the through-holes 520 in order to come into contact with the corner portions of the end faces of the inner core portions 31 (inner core pieces 31*m*). The projections 523 are disposed between the corner portions of the end faces of the inner core portions 31 and the inward end faces 32*e* of the outer core portions 32, and as shown in FIG. 5, gaps are thus formed between the end faces of the inner core portions 31 and the inward end faces 32*e* of the outer core portions 32. Also, as shown in FIG. 6, the through-holes 520 are each cross-shaped, and when the assembly 10 is obtained, resin filling holes 524 that achieve communication between the gaps between the inner peripheral faces of the winding portions 2*c* and the outer peripheral faces of the inner core portions 31 are formed in the through-holes 520. Resin can thus be introduced into the gaps between the winding portions 2*c* and the inner core portions 31 via the resin filling holes 524.

As shown in FIGS. 3 and 6, the outer core portion 32 sides (front sides) of the end face intervening members 52 are provided with recessed fitting portions 525 into which the inward end face 32*e* sides of the outer core portions 32 are fitted, and the outer core portions 32 are positioned relative to the end face intervening members 52 by the fitting portions 525. As shown in FIG. 3, the inner core portion 31 side (reverse face side) of each of the end face intervening members 52 is provided with projecting pieces 521 that extend in the length direction along the corner portions of the inner core pieces 31*m* located at the end portions of the inner core portions 31. The projecting pieces 521 hold the corner portions of the inner core pieces 31*m* located at the end portions of the inner core portions 31, and are disposed between the inner peripheral faces of the winding portions 2*c* and the outer peripheral faces of the core pieces 31*m* so as to position the inner core pieces 31*m* (inner core portions 31) in the winding portions 2*c*. The inner core portions 31 are positioned relative to the end face intervening members 52 by the projecting pieces 521, and as a result, the inner core portions 31 and the outer core portions 32 can be positioned via the end face intervening members 52. Also, as shown in FIG. 2, the projecting pieces 521 of the end face intervening members 52 abut against and are connected to the projecting pieces 511 of the inner intervening members 51. Accordingly, as shown in FIG. 4, the gaps between the inner peripheral faces of the winding portions 2*c* and the outer peripheral faces of the inner core portions 31 are divided in the peripheral direction by the projecting pieces 511 and the projecting pieces 521 over the length direction of the inner core portions 31.

Spacer Pieces

As shown in FIGS. 1 to 5, the spacer pieces 55, which are disposed between the winding portions 2*c*, are integrated with the end face intervening members 52. As shown in FIGS. 3 to 5, the spacer pieces 55 project from the inner core portion 31 side (reverse face side) of the end face intervening members 52, and are disposed extending between the entirety of the mutually opposing inward faces of the two winding portions 2*c*. The spacer pieces 55 are large enough to face the entirety of the inward faces of the two winding portions 2*c*, and are formed so as to come into contact with the entirety of the inward faces (entire lengths and heights thereof) of the winding portions 2*c*. In this example, as shown in FIGS. 4 and 5, the spacer pieces 55 extend over the entire length of the inward faces in the length direction and extend over the entire height of the inward faces in the height direction, the length of the spacer pieces 55 is equivalent to the length of the inward faces, and the height of the spacer pieces 55 is equivalent to the height of the inward faces. The thickness of the spacer pieces 55 is equivalent to the distance between the winding portions 2*c*, and is in the range of 1 mm to 5 mm inclusive, for example.

Also, in this example, as shown in FIGS. 2 and 5, the spacer pieces 55 are integrated with the end face intervening members 52, and the leading end portions of the spacer pieces 55 abut against each other so as to be continuous. The spacer pieces 55 may have the same length as each other as shown in FIGS. 2 and 5, or the spacer pieces 55 on one side may be longer than those on the other side. Also, a configuration is possible in which protrusions/recessions or steps are formed in the leading end portions of the spacer pieces 55 such that the leading end portions of the spacer pieces 55 on the two sides engage with each other. Alternatively, a configuration is possible in which the spacer pieces 55 are formed on only one of the end face intervening members 52. In this case, the other end face intervening member 52 may be provided with recession portions for receiving the leading end portions of the spacer pieces 55.

Inner Resin Portion

As shown in FIGS. 4 and 5, the inner resin portion 41 is formed by filling the space between the inner peripheral faces of the winding portions 2*c* and the outer peripheral faces of the inner core portions 31 with resin, and is in close contact with the inner peripheral faces of the winding portions 2*c* and the outer peripheral faces of the inner core portions 31. The inner resin portion 41 is formed by filling the space with resin through injection molding.

The inner resin portion 41 is formed by electrically insulating resin. The resin that forms the inner resin portion 41 can be a thermosetting resin, thermoplastic resin, room temperature curing resin, low temperature curing resin, or the like. Examples include a thermosetting resin such as epoxy resin, unsaturated polyester resin, urethane resin, and silicone resin, and a thermoplastic resin such a PPS resin, PTFE resin, LCP, PA resin, PI resin, PBT resin, and ABS resin.

In this example, as shown in FIGS. 1 and 2, outer resin portions 42 cover at least a portion of the outer surfaces of the outer core portions 32. The outer resin portions 42 are integrated with the inner resin portion 41, and as shown in FIG. 5, the molded resin portion 4 is constituted by the inner resin portion 41 and the outer resin portions 42. The inner core portions 31 and the outer core portions 32 are integrated by the molded resin portion 4, and the coil 2, the magnetic core 3, and furthermore the insulating intervening member 5 that constitute the assembly 10 are integrated by the molded resin portion 4. Also, as shown in FIG. 5, resin also fills the gaps between the end faces of the inner core portions 31 and the inward end faces 32*e* of the outer core portions 32.

Reactor Manufacturing Method

The following describes an example of a method for manufacturing the reactor 1. This reactor manufacturing method mainly includes an assembly assembling step and a resin filling step.

Assembly Assembling Step

In the assembly assembling step, the coil 2, the magnetic core 3, and the insulating intervening member 5 are combined to assemble the assembly 10 (see FIG. 3).

In this example, the inner core portions 31 are produced by disposing the inner intervening members 51 between the inner core pieces 31*m*, and then the inner core portions 31 are inserted into the respective winding portions 2*c* of the coil 2. Subsequently, the end face intervening members 52 are disposed at the two ends of the winding portions 2*c*, and the outer core portions 32 are disposed so as to sandwich the ends of the inner core portions 31. Accordingly, the loop-shaped magnetic core 3 (see FIG. 2) is constituted by the inner core portions 31 and the outer core portions 32. In this manner, the assembly 10 is assembled by combining the coil 2, the magnetic core 3, and the insulating intervening member 5.

Resin Filling Step

In the resin filling step, the inner resin portion 41 is formed by filling the space between the inner peripheral faces of the winding portions 2*c* and the inner core portions 31 with resin (see FIGS. 4 and 5).

In this example, the assembly 10 is set in a mold that is not shown, and the end face intervening member 52 is fixed in the mold. This mold is formed such that when the assembly 10 is fixed therein, the outward faces of the two winding portions 2*c* of the coil 2 come into contact with the inward faces of the mold. Resin is then injected from the outer core portion 32 sides of the assembly 10, and the resin is introduced to the gaps between the winding portions 2*c* and the inner core portions 31 via the resin filling holes 524 of the end face intervening members 52. At this time, the resin also fills the gaps between the end faces of the inner core portions 31 and the inward end faces 32*e* of the outer core portions 32. Subsequently, the resin is allowed to cure, thus forming the inner resin portion 41. Also, in this example, at the same time as the inner resin portion 41 is formed, the outer resin portion 42 is formed such that the outer core portions 32 are also covered with resin, thus integrating the inner resin portion 41 and the outer resin portions 42. Accordingly, the molded resin portion 4 is constituted by the inner resin portion 41 and the outer resin portions 42, the inner core portions 31 and the outer core portions 32 are integrated with each other, and the coil 2, the magnetic core 3, and the insulating intervening member 5 are integrated with each other.

The resin may be injected into the gaps between the winding portions 2*c* and the inner core portions 31 in a direction from one of the outer core portions 32 toward the other outer core portion 32, or may be injected into the gaps from both of the outer core portion 32 sides.

In this example, the projecting pieces 511 of the inner intervening members 51 and the projecting pieces 521 of the end face intervening members 52 are connected in the length direction along the corner portions of the inner core portions 31 (see FIG. 2), and therefore the gaps between the winding portions 2*c* and the inner core portions 31 are divided in the peripheral direction (see FIG. 4). This therefore enables suppressing the formation of welds caused by the merging of resin flowing in the gaps, thus making it possible to avoid the formation of welds in the inner resin portion 41.

Actions and Effects

The reactor 1 of the first embodiment has actions and effects such as the following.

Due to including the spacer pieces 55 that are disposed between the winding portions 2*c*, it is possible to suppress outward deformation of the inward faces of the winding portions 2*c* caused by the pressure of the resin when the space between the inner peripheral faces of the winding portions 2*c* and the inner core portions 31 is filled with the resin in order to form the inner resin portion 41. Accordingly, contact between the inward faces of the two winding portions 2*c* can be avoided. Particularly in the case where the coil 2 is disposed such that the long end sides of the end faces of the winding portions 2*c* are the inward faces, the spacer pieces 55 can suppress deformation of the inward faces of the winding portions 2*c*, are thus are very effective.

The spacer pieces 55 are disposed extending between the entirety of the mutually opposing inward faces of the two winding portions 2*c*, thus making it possible to suppress deformation over the entirety of the inward faces and to avoid contact between the winding portions 2*c*. Also, the spacer pieces 55 are integrated with the end face intervening members 52, thus eliminating the need to dispose and remove separate spacers, and therefore workability can be improved.

Applications

The reactor 1 of the first embodiment can be favorably applied to various types of converters such as in-vehicle converters (typically DC-DC converters) for installation in a vehicle such as a hybrid automobile, a plug-in hybrid automobile, an electric automobile, or a fuel cell automobile, and furthermore can be favorably applied to a constituent component of a power conversion apparatus, for example.

Variations

Figure 7:
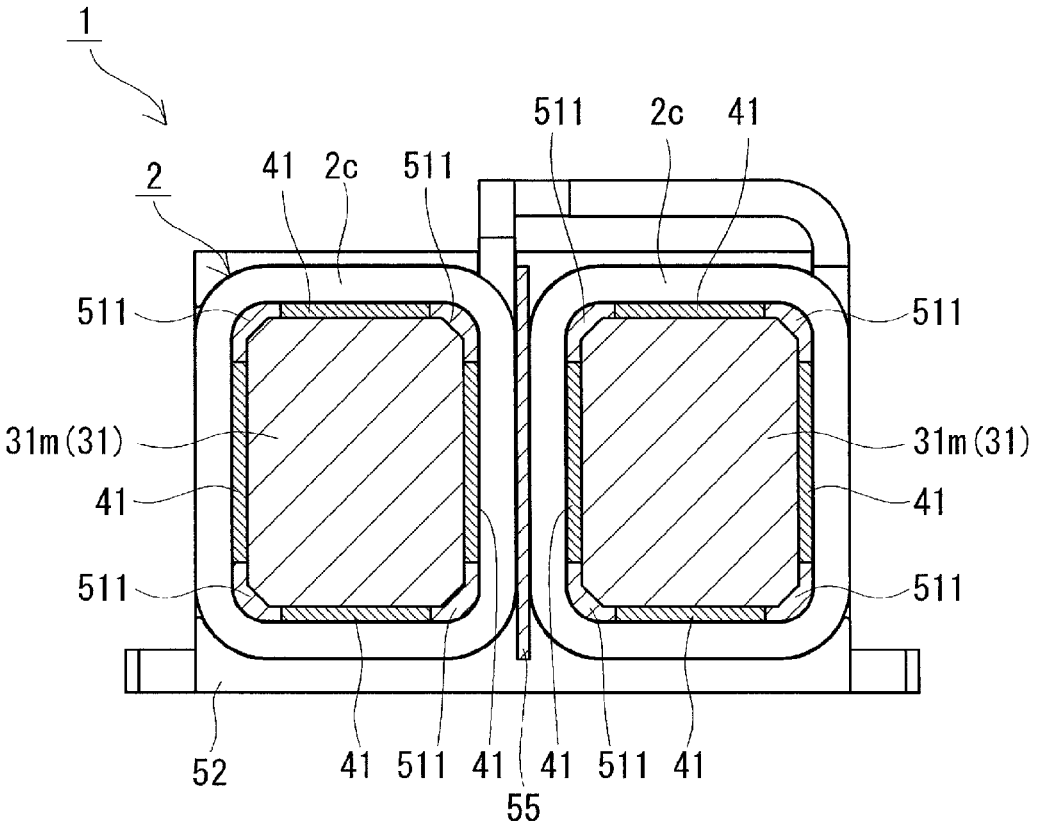
FIG. 7 is a schematic transverse sectional view of a variation of a spacer piece.

In the aspect of the reactor 1 of the first embodiment described above, the height of the spacer pieces 55 is equivalent to the height of the inward faces of the winding portions 2*c* as shown in FIG. 4. There is no limitation to this, and an aspect is possible in which, for example, as shown in FIG. 7, the height of the spacer pieces 55 is greater than the height of the inward faces of the winding portion 2*c*, and the upper end portions and lower end portions of the spacer pieces 55 project outward from the inward faces. In FIG. 7, the height of the spacer pieces 55 is equivalent to the height of the winding portions 2*c* (the distance from the upper face to the lower face), and the upper end portions and lower end portions of the spacer pieces 55 project into the spaces between the mutually opposing upper and lower corner portions on the inward sides of the two winding portions 2*c*. If the upper end portions and lower end portions of the spacer pieces 55 project upward and downward from the inward faces as with the spacer pieces 55 shown in the variation in FIG. 7, the distance between the surfaces of the winding portions 2*c* increases, and it is possible to improve the electrical insulation between the winding portions 2*c*. It is sufficient that the projecting lengths of the upper end portions and lower end portions of the spacer pieces 55 are suitably set so as to enable ensuring a necessary creepage distance in accordance with the application voltage of the coil 2, the usage environment, and the like.

The invention claimed is:

1. A reactor comprising a coil and a loop-shaped magnetic core disposed extending inside and outside the coil, wherein the coil has two winding portions that are disposed laterally side-by-side, the magnetic core has two inner core portions that are disposed inside the winding portions, and two outer core portions that are disposed outside the winding portions and connect end portions of the two inner core portions, and the reactor further comprises:

an inner resin portion obtained by filling a space between inner peripheral faces of the winding portions and the inner core portions;

a pair of end face intervening members, each of the pair of end face intervening members disposed between end faces of the winding portions and a corresponding one of the two outer core portions; and a pair of spacer pieces that are integrated with a corresponding one of the end face intervening members, each of the pair of spacer pieces having a first end opposite of a second end, the first end integrally formed with a corresponding one of the end face intervening members and the second ends contacting each other so as to extend between an entirety of mutually opposing inward faces of the two winding portions.

2. The reactor according to claim 1, wherein a height of the spacer pieces in an up-down direction is greater than a height of the inward faces of the winding portions, and upper end portions and lower end portions of the spacer pieces project beyond the inward faces.

3. The reactor according to claim 1, wherein end faces of the winding portions have a rectangular shape in a view along an axial direction, and the winding portions are disposed such that long end sides of the rectangular shape of the end faces are the inward faces.

4. The reactor according to claim 2, wherein end faces of the winding portions have a rectangular shape in a view along an axial direction, and the winding portions are disposed such that long end sides of the rectangular shape of the end faces are the inward faces.

* * * * *